US006464311B2

(12) United States Patent
Liang et al.

(10) Patent No.: US 6,464,311 B2
(45) Date of Patent: Oct. 15, 2002

(54) LOCK AND RELEASE MECHANISM FOR SLIDE ASSEMBLY

(75) Inventors: Hsiu-Chiang Liang; Keng-Chin Chen; Chun-Chiang Wang, all of Kaohsiung (TW)

(73) Assignee: King Slide Works Co., Ltd., Kaohsiung (TW)

( * ) Notice: Subject to any disclaimer, the term of this patent is extended or adjusted under 35 U.S.C. 154(b) by 0 days.

(21) Appl. No.: 09/820,978

(22) Filed: Mar. 30, 2001

(65) Prior Publication Data

US 2002/0089272 A1 Jul. 11, 2002

(30) Foreign Application Priority Data

Jan. 5, 2001 (TW) ..... 90200190

(51) Int. Cl.[7] ..... A47B 881/16
(52) U.S. Cl. ..... 312/334.46; 312/333
(58) Field of Search ..... 312/333, 334.44, 312/334.45, 334.46, 334.47; 384/21

(56) References Cited

U.S. PATENT DOCUMENTS 461,375 A * 10/1891 Spaunhorst
3,658,394 A * 4/1972 Gutner ..... 312/334.46 X
4,560,212 A 12/1985 Papp et al.
4,998,828 A * 3/1991 Hobbs ..... 312/334.46 X
5,417,490 A * 5/1995 Hobbs et al. ..... 312/334.47

* cited by examiner

*Primary Examiner*—Janet M. Wilkens
(74) *Attorney, Agent, or Firm*—Birch, Stewart, Kolasch & Birch, LLP

(57) ABSTRACT

A slide comprises an outer member, an intermediate member, and an inner member. The intermediate member is held in place when slide is fully pulled out to a locked out position. A lock and release mechanism for the slide comprises a flexible strip having a proximal end attached to the intermediate member and a distal end slantingly extended. A fork at the end of flexible strip is lowered to be locked by a stop member on the outer member as the intermediate member is extended to the locked out position by the removing inner member. Hence, the intermediate member is held in the locked out position. The flexible strip has a trigger member capable of lifting together with the fork to disengage from the stop member as retracting the inner member, thereby unlocking the intermediate member.

10 Claims, 9 Drawing Sheets

LOCK AND RELEASE MECHANISM FOR SLIDE ASSEMBLY

BACKGROUND OF THE INVENTION

1. Field of Invention

The present invention relates to drawer slides and more particularly to a lock and release mechanism for slide assembly with improved characteristics.

2. Related Art

Conventionally, a slide is employed to enable the relative movement of a drawer and a cabinet, a computer desk and a keyboard shelf, or the like. A conventional slide comprises an outer member, an intermediate member, and an inner member. For example in the drawer and cabinet configuration, outer member is affixed to the wall of cabinet, inner member is affixed to the side of drawer, and intermediate member is slidably received in outer member for holding inner member in a sliding relationship. Typically, a ball bearing mechanism is employed to interconnect above any two adjacent members. Hence, inner member and intermediate member may coaxially move respect to outer member. Thus drawer is permitted to remove to its maximum extension or retract into the cabinet. Typically, a stop mechanism such as latch is employed to lock slide in a fully extended position (also called as locked out position) when slide reaches its maximum extension. At this time, intermediate member and outer member are held in place by the latch. Hence, load (e.g., drawer) supported by inner member is also held in this place. One such latch based lock and release mechanism in cooperation with inner member, intermediate member, and outer member is disclosed in U.S. Pat. No. 4,560,212, which is incorporated herein by reference. In this prior art, intermediate member is held by a locking device in a locked out position with respect to outer member. This locking device has a latch held on the intermediate member having a stop surface at the inner end thereof and a cam surface extending in the path of travel of the inner member. When the inner member is released and moves inwardly, its inner end contacts the latch and releases the intermediate member with respect to the outer member thus permitting the slide to be completely retracted.

SUMMARY OF THE INVENTION

It is therefore an object of the present invention to provide a lock and release mechanism for slide such that an intermediate member is held in place when slide is pulled out to a fully extended position also known as locked out position.

In one aspect of the present invention, a flexible strip has one end attached to the intermediate member. The flexible strip is lowered toward the outer member when the intermediate member has moved to the locked out position. A stop member is situated near the front end of outer member. The flexible strip has a trigger member capable of lifting together with the flexible strip to disengage from the stop member as retracting the inner member, thereby releasing the lock and release mechanism.

In one preferred embodiment of the present invention, the trigger member is lifted by a cam plate on the rear end of the inner member.

In another preferred embodiment of the present invention, the trigger member is lifted by a cam while extending the inner member.

In still another preferred embodiment of the present invention, the trigger member is lifted by a lever while extending the inner member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become fully understood from the detailed description given hereinbelow illustration only, and thus are not limitative of the present invention, and wherein.

DETAILED DESCRIPTION OF THE INVENTION

Figure 1:
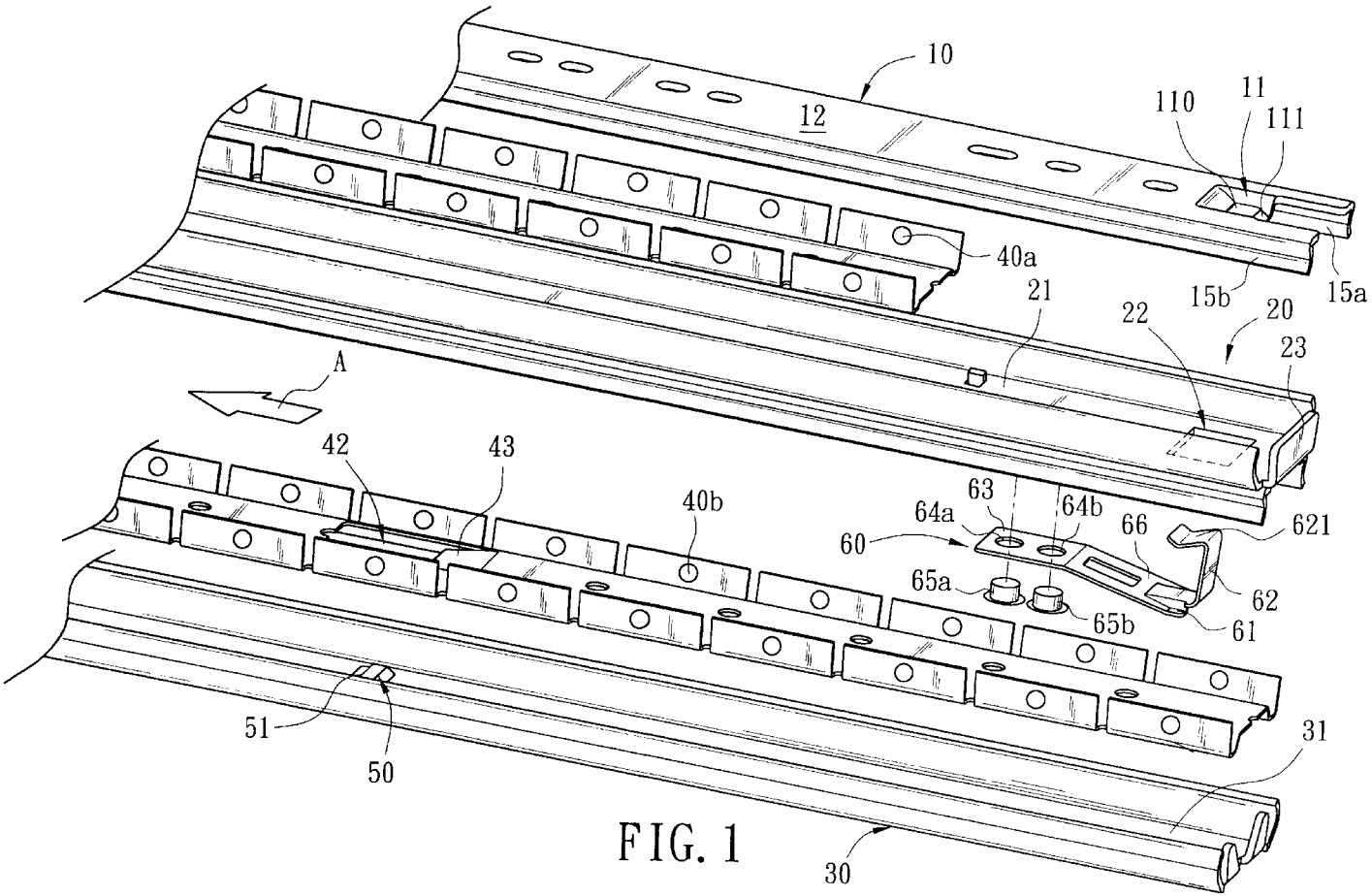
FIG. 1 is an exploded perspective view of a first preferred embodiment of lock and release mechanism slide assembly according to the invention.

Referring to FIGS. 1 to 4, there is shown a slide assembly constructed in accordance with the invention comprising an outer member 30, an intermediate member 20, and an inner member 10. This embodiment is implemented in a drawer and a cabinet combination wherein two pair of slides are employed to effectuate a relative sliding movement therebetween. Outer member 30 is affixed to the wall of cabinet. Inner member 10 is affixed to either side of drawer. Intermediate member 20 is slidably received in outer member 30 for holding inner member 10 in a sliding relationship. Typically, a ball bearing mechanism (e.g., ball bearings 40*a* and 40*b*) is employed to interconnect above any two adjacent members. Hence, inner member 10 and intermediate member 20 may coaxially move respect to outer member 30. When drawer is pulled out to its maximum extension, slide is also extended to a fully extended position (i.e., locked out position). At this position, intermediate member 20 and outer member 30 are locked and held in place by a stop mechanism (i.e., lock and release mechanism). When the lock and release mechanism is released, intermediate member 20 is free to move inwardly until drawer is completely received in cabinet. The components of the lock and release mechanism are as follows:

Stop member 50 is affixed to a position near the front end of outer member 30 as indicated by arrow A in FIG. 1. Stop member 50 is bent toward intermediate member 20 and comprises a first ramp 51. Flexible strip 60 has one end attached to intermediate member 20 and the other end bent and extended toward outer member 30. Flexible strip 60 further comprises a distal fork 61 (which is urged against first ramp 51 of stop member 50 when inner member 10 is pulled out to its maximum extension, i.e., at locked position), a trigger member 62 extended from between the fork 61 toward inner member 10 through an opening 22 on the bottom 21 of intermediate member 20, and a hook 621 formed at the free end of trigger member 62. Release mechanism functions to pull trigger member 62 up by the movement of inner member 10 while inner member 10 is retracting, resulting in a disengagement of fork 61 and ramp 51 and an unlocking of intermediate member 20. A number of embodiments of release mechanism are detailed below.

As shown, stop member 50 is situated on the bottom 31 of outer member 30. In one implementation, stop member 50 is formed by stamping on the bottom 31 and is bent toward intermediate member 20 to form a first ramp 51. In another implementation, stop member 50 is formed by attaching (e.g., welding) a pre-formed metal piece onto the bottom 31. Two rows of ball bearings 40*b* are provided between intermediate member 20 and outer member 30. A punched opening 42 is formed on inner wall of bearing 40*b*. A slope 43 is formed at one end of opening 42 on the inner wall of bearing 40*b*. When intermediate member 20 and inner member 10 are pulled out toward a predetermined locked position, fork 61 may move toward the front end of outer member 30 to enter into opening 42 through slope 43. Eventually, fork 61 is lowered to urge against first ramp 51 of stop member 50. To the contrary, when fork 61 becomes disengaged from first ramp 51, fork 61 may be guided to clear from opening 42 to move toward the rear of intermediate member 20 through slope 43.

Figure 2:
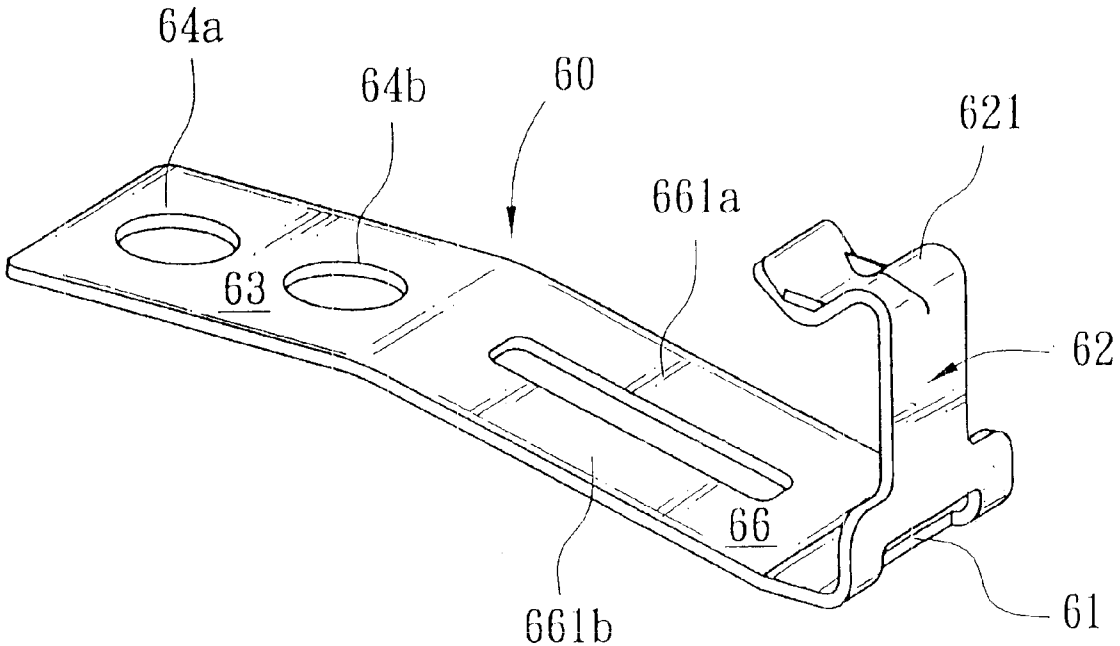
FIG. 2 is a perspective view of flexible strip of FIG. 1.
Figure 3:
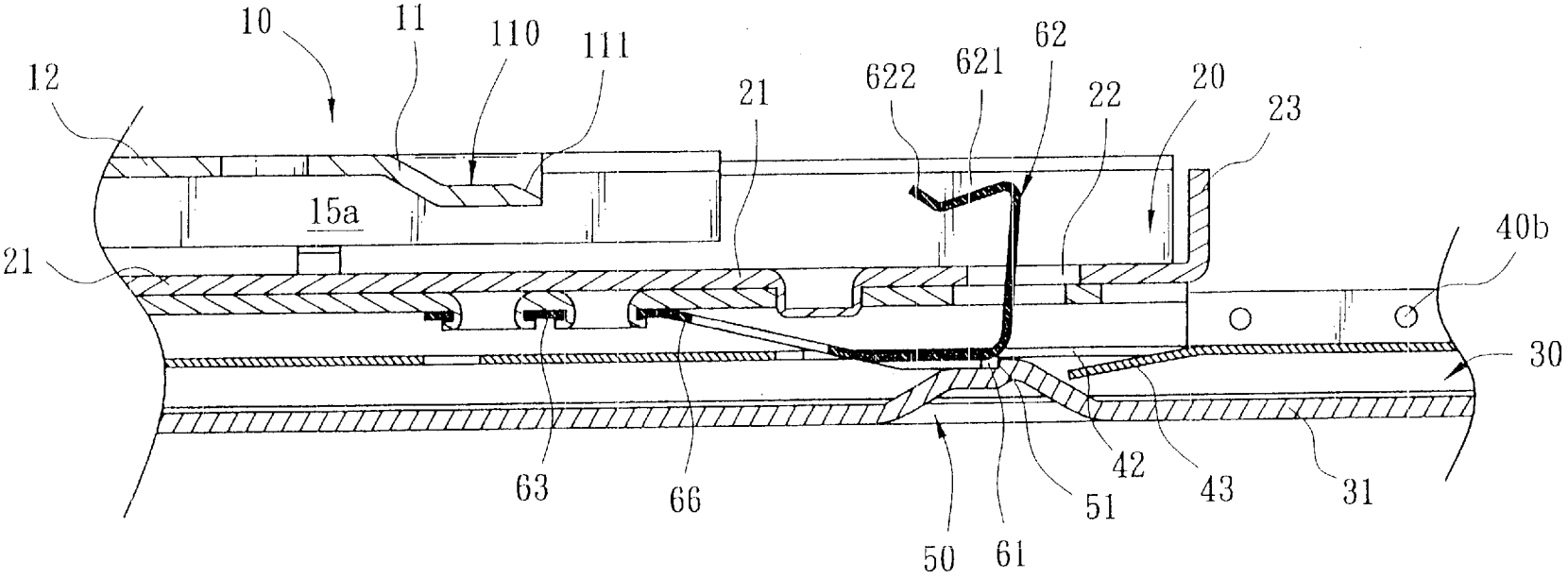
FIG. 3 is a sectional view of FIG. 1.
Figure 4:
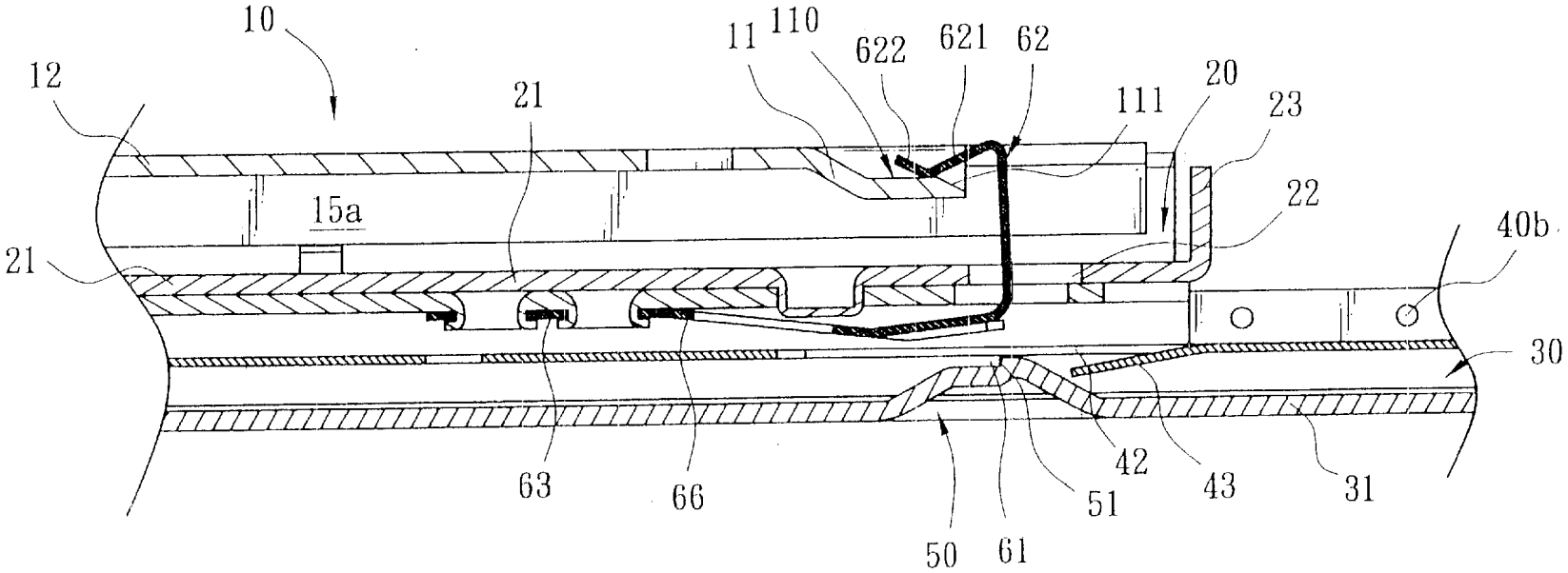
FIG. 4 is a view similar to FIG. 3 illustrating the disengagement of flexible strip and outer member.

Referring to FIG. 2 specifically, flexible strip 60 is preferably formed by punching and stamping a metal piece which is high in quality and flexible. There are many implementations to attach one end of flexible strip 60 to intermediate member 20. In the example shown in FIG. 1, a plurality of holes 64*a* and 64*b* are formed on attachment section 63 of flexible strip 60. Further, shoulder rivets 65*a* and 65*b* (or other fasteners) are inserted in holes 64*a* and 64*b* to secure flexible strip 60 to intermediate member 20. Alternatively, secure the attachment section 63 of flexible strip 60 onto the inner wall 21 of intermediate member 20 by punching (FIG. 3). Fork 61 is substantially parallel oriented with respect to the inner wall 31 of outer member 30. Fork 61 is extended from the distal end of connection element 66 which is interconnected between the attachment section 63 and fork 61. An elongate slot is provided on connection element 66 so as to form two connection members 661*a* and 661*b* on the sides of the slot. Such connection members 661*a* and 661*b* can provide necessary flexibility of flexible strip 60. Further, a plurality of widthwise ribs (not shown) may be formed on connection element 66 for increasing the mechanical strength of connection element 66, thereby preventing connection element 66 from being deformed after repeatedly contacting with first ramp 51 on outer member 30. Preferably, trigger member 62 is formed at the distal end of connection element 66. Thus fork 61 may quickly disengage from first ramp 51 of stop member 50 when hook 621 of trigger member 62 is pulled up by inner member 10 (FIG. 4). A first embodiment of release mechanism is shown in FIG. 1. A cam plate 11 is formed on the rear end of inner member 10 for pulling hook 621 up. Likewise, cam plate 11 may be formed by punching on inner wall 12 of inner member 10 by punching. Cam plate 11 comprises a bearing surface 110 and a first slope 111 oriented toward the rear of inner member 10. When fork 61 is pushed down to urge against first ramp 51 of stop member 50, the lowest point of first slope 111 is lower than that of hook 621 (FIG. 3). Alternatively, a guide slope 622 is formed on the free end of hook 621 for guiding hook 621 to slide onto first slope 111. When inner member 10 is retracted inwardly to reach the rear end of intermediate member 20, hook 621 may slide onto bearing surface 110 along first slope 111 of cam plate 11. As a result, fork 61 is lifted away from first ramp 51 to release the locking of intermediate member 20 and outer member 30. It is required that the height of bearing surface 110 be sufficient in order to lift trigger member 62 and fork 61 up from first ramp 51.

Figure 5:
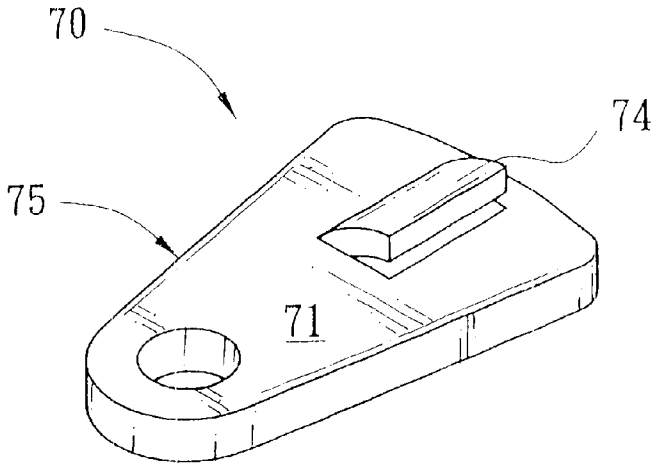
FIG. 5 is a perspective view of cam of a second preferred embodiment according to the invention.
Figure 6:
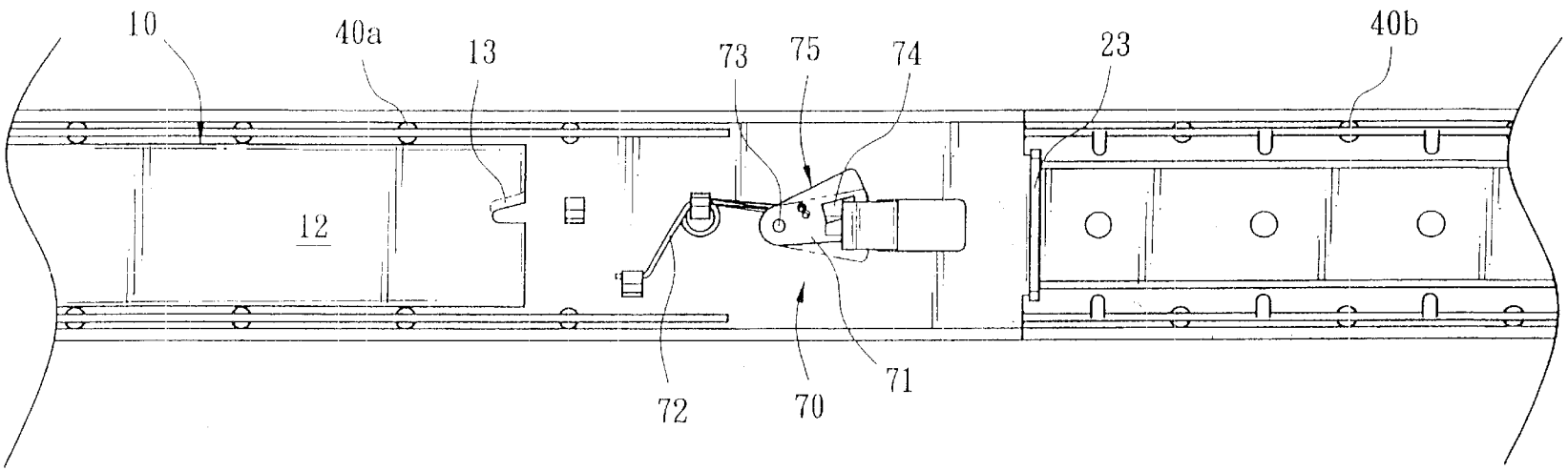
FIG. 6 is a side view illustrating the operation of cam.
Figure 7:
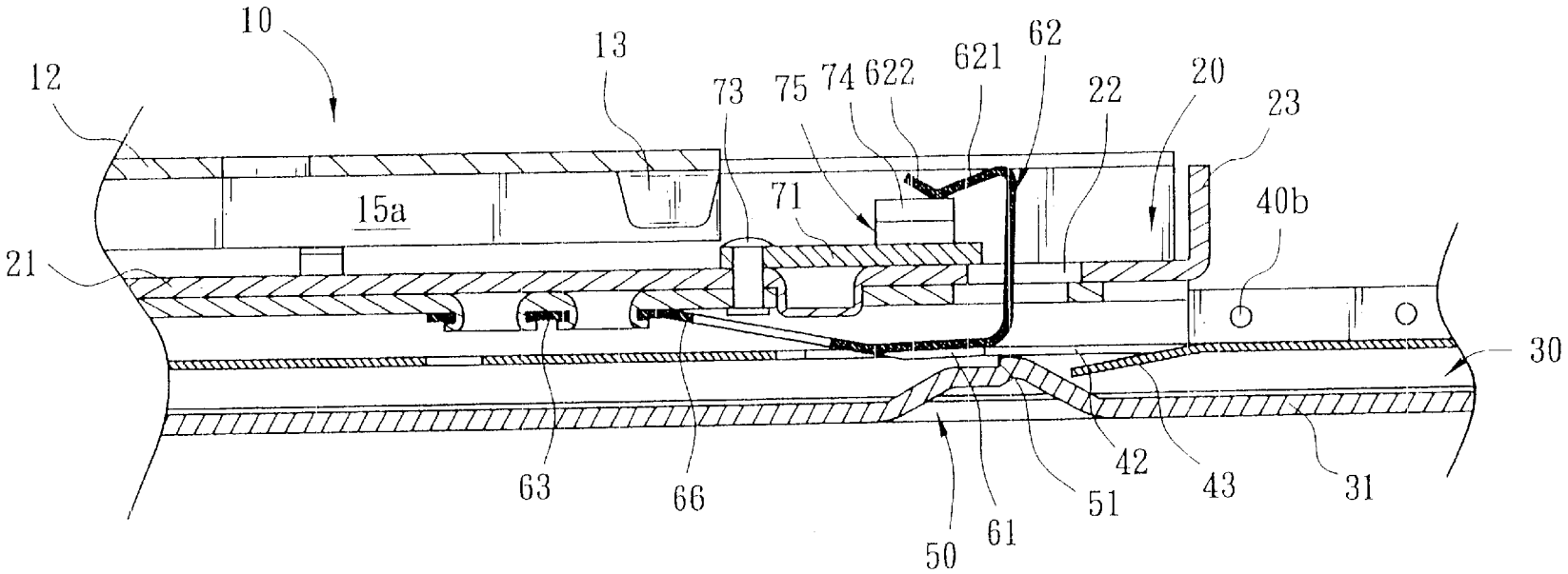
FIG. 7 is a sectional view of FIG. 6 illustrating the disengagement of flexible strip and stop member by the pivoting cam.

Referring to FIGS. 5, 6 and 7, a second embodiment of release mechanism is shown. A cam 70 is provided on intermediate member 20 for lifting trigger member 62 and flexible strip 60. Cam 70 comprises a plate 71, a spring 72, a pivot pin 73 (e.g., the stem of rivet) passed through the plate 71, and a projected second ramp 74. Hence, when the plate 71 pivots about the pin 73, second ramp 74 may contact the hook 621 of trigger member 62 and second ramp 74 may pass under the hook 621. Plate 71 is held in a nonrotating position by spring 72 in a normal state (FIG. 6). Inner member 10 has a downward tab 13 (which may be formed by stamping on inner wall 12 of inner member 10). Edge 75 of plate 71 is in the travel path of tab 13 when plate 71 is held in the nonrotating position. When inner member 10 moves to the inner end of intermediate member 20 as retracting drawer, tab 13 may urge against the edge 75 of plate 71 to cause second ramp 74 to pass under the hook 621, thereby sliding hook 621 and fork 61 along the upwardly oriented second ramp 74 for disengaging from first ramp 51 (FIG. 7).

Figure 8:
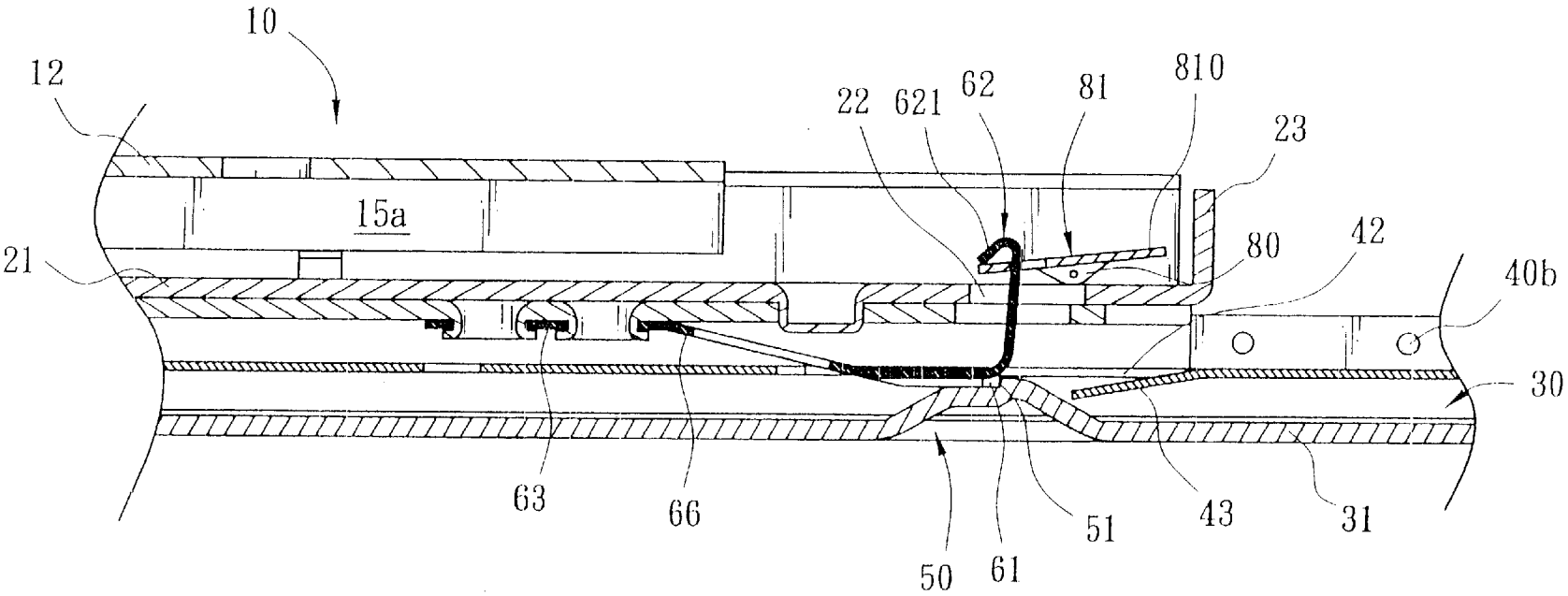
FIG. 8 is a sectional view of a third preferred embodiment according to the invention illustrating the relationship between lever and trigger member.
Figure 9:
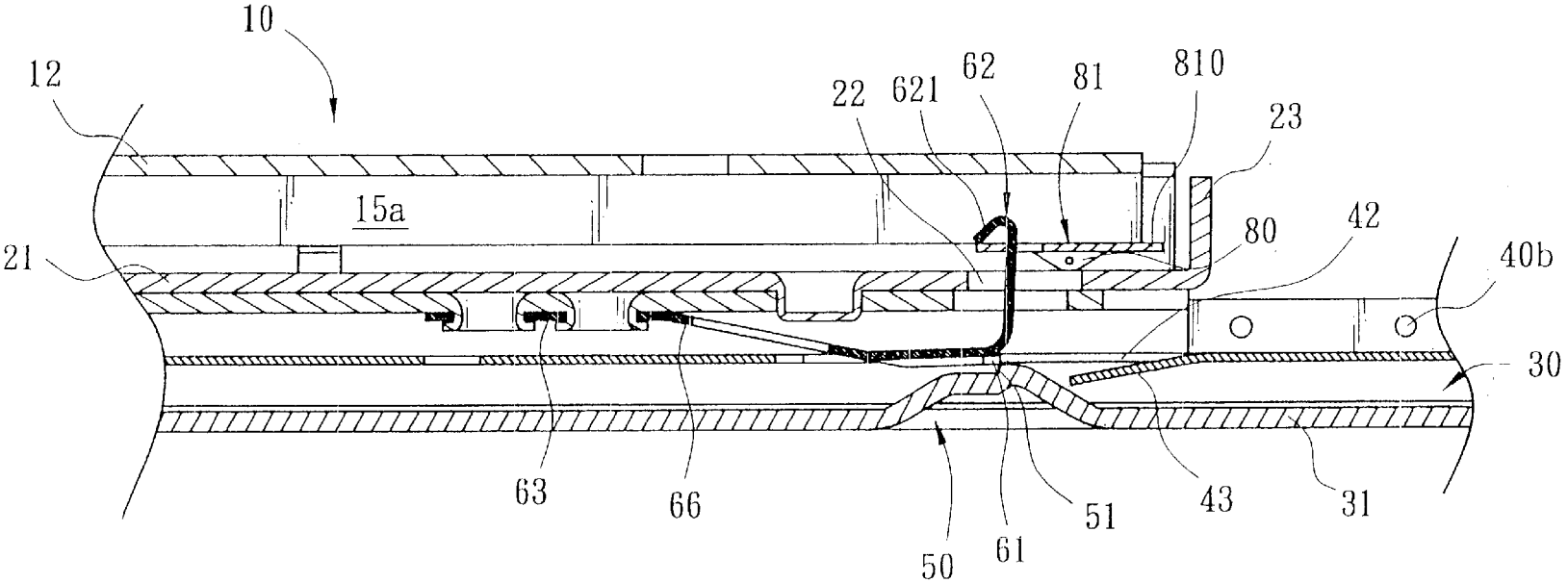
FIG. 9 is a view similar to FIG. 9 illustrating the disengagement of flexible strip and stop member by the pivoting lever.

Referring to FIGS. 8 and 9, a third embodiment of release mechanism is shown. A lever 81 comprises a pivot 80 fixed to intermediate member 20. One proximal end of lever 81 is extended below hook 621. As stated above, in the locked out position hook 621 is lowered to cause the proximal end of lever 81 to lower too as flexible strip 60 lowers. Hence the distal end 810 of lever 81 is lifted. Further, the distal end 810 of lever 81 is above the inner wall between sides 15*a* and 15*b* of inner member 10 by the lifted distance. When inner member 10 moves to the inner end of intermediate member 20 as retracting drawer, the end of inner wall between sides 15*a* and 15*b* of inner member 10 may press the distal end 810 of lever 81 to cause the proximal end of lever 81 to lift hook 621 and fork 61 up for disengaging from first ramp 51 (FIG. 9). Moreover, an upright member 23 is provided at the inner end of intermediate member 20. Hence, when inner member 10 moves to the inner end of intermediate member 20 as retracting drawer, inner member 10 is stopped by the upright member 23 for protecting trigger member 62 and hook 621.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A locking mechanism for a slide including an outer member, an intermediate member, and an inner member with said intermediate and said outer members being held in place when said intermediate member is fully pulled out to a locked position as said inner member extends, said mechanism comprising:

a stop member affixed to said outer member, said stop member including a first ramp toward said intermediate member;

a flexible strip having one proximal end attached to said intermediate member, said other end bent and extended toward said outer member, a fork at a distal end, a trigger member extended from between said fork toward said inner member, and a hook at said free end of said trigger member; and a release mechanism for pulling said trigger member up by said movement of said inner member as retracting said inner member, thereby disengaging said fork and said first ramp for unlocking said intermediate member.

2. The locking mechanism of claim 1, wherein said fork is substantially parallel oriented with respect to said bottom of said outer member.

3. The locking mechanism of claim 1, wherein said flexible strip further comprises a connection element interconnected between said proximal end and said fork, an elongate slot on said connection element, and two connection members on said sides of said slot for increasing flexibility of said flexible strip.

4. The locking mechanism of claim 1, wherein said release mechanism comprises a cam plate on said rear end of said inner member for pulling said trigger member and said fork up as retracting said inner member, thereby disengaging said trigger member and said fork from said first ramp.

5. The locking mechanism of claim 4, wherein said cam plate comprises a bearing surface and a first slope oriented toward said rear of said inner member so that when said inner member is retracted inwardly to reach said rear end of said intermediate member, said hook slides onto said bearing surface along the first slope for lifting said fork from said first ramp.

6. The locking mechanism of claim 5, wherein said fork is operable to push down to urge against said first ramp for causing a lowest point of said first slope to be lowered than that of said hook.

7. The locking mechanism of claim 5, further comprising a guide slope on said free end of said hook for guiding said hook to slide onto said first slope.

8. The locking mechanism of claim 1, wherein said release mechanism further comprises a cam plate and a downward tab on said inner member so that when said inner member retracts, said tab is urged against said cam plate to lift said trigger member and said fork, thereby disengaging said trigger member and said fork from said first ramp.

9. The locking mechanism of claim 8, wherein said cam comprises a plate, a spring, a pin passed through said plate, and a projected second ramp so that when said plate is operable to pivot about said pin said second ramp is brought into contact with said hook and passed under said hook.

10. The locking mechanism of claim 1, wherein said release mechanism further comprises a lever including a pivot fixed to said intermediate member with said proximal end of said lever extended below said hook, and wherein in said locked out position said hook is lowered to cause said proximal end of said lever to lower too as said flexible strip lowers, thereby lifting said distal end of said lever so that when said inner member retracts to move to said inner end of said intermediate member, said distal end of said lever is pressed by said inner member to cause said proximal end of said lever to lift said trigger member and said fork, thereby disengaging said trigger member and said fork from said first ramp.

* * * * *